US005238481A

United States Patent [19]

Takagi et al.

[11] Patent Number: 5,238,481

[45] Date of Patent: Aug. 24, 1993

[54] HEAT RESISTANT SINTERED HARD ALLOY

[75] Inventors: Kenichi Takagi; Masao Komai; Yoshihiko Isobe, all of Kudamatsu, Japan

[73] Assignee: Toyo Kohan Co., Ltd., Tokyo, Japan

[21] Appl. No.: 824,436

[22] Filed: Jan. 23, 1992

[51] Int. Cl.[5] ..... C22C 29/00

[52] U.S. Cl. ..... 75/244; 75/246; 420/435; 420/436; 148/408; 148/419

[58] Field of Search ..... 420/435, 436; 148/408, 148/419; 75/246, 248, 254, 244

[56] References Cited

U.S. PATENT DOCUMENTS

| | | | |
|---|---|---|---|
| Re. 28,552 | 9/1975 | Smith | 148/32 |
| 2,097,176 | 10/1937 | de Crolyer | 148/408 |
| 2,776,468 | 1/1957 | Steinitz | 75/244 |
| 3,933,482 | 1/1976 | Dudko et al. | 75/159 |
| 4,089,682 | 5/1978 | Saito et al. | 75/236 |
| 4,133,682 | 1/1979 | Ray | 148/403 |
| 4,210,443 | 1/1980 | Ray | 148/403 |
| 4,427,446 | 1/1984 | Miura et al. | 75/244 |
| 4,523,950 | 6/1985 | Wan et al. | 420/429 |
| 4,533,389 | 8/1985 | Kapoor et al. | 420/94 |
| 4,561,889 | 12/1985 | Oaku et al. | 75/125 |
| 4,743,513 | 5/1988 | Scruggs | 428/668 |
| 4,961,781 | 10/1990 | Morishita et al. | 75/244 |

*Primary Examiner*—Donald P. Walsh
*Assistant Examiner*—Ngoclan T. Mai
*Attorney, Agent, or Firm*—Felfe & Lynch

[57] ABSTRACT

A heat-resistant sintered hard alloy comprises 35% to 95% by weight of a WCoB type complex boride in a cobalt base alloy. The alloy contains 1.5% to 4.1% boron, 19.1% to 69.7% tungsten, optionally to 25% chromium, the balance being cobalt and a maximum of 1% impurities. Nickel, iron and/or copper may be substituted for portions of the cobalt content.

2 Claims, No Drawings

HEAT RESISTANT SINTERED HARD ALLOY

BACKGROUND OF THE INVENTION

The present invention relates to a heat-resistant sintered hard alloy, composed of a hard phase consisting mainly of a WCoB type complex boride, and a cobalt base alloy matrix phase binding the hard phase which hard alloy exhibits excellent room temperature characteristics as well as excellent high temperature characteristics such as high temperature strength and oxidation resistance, and as a hot extruding die for a copper rod.

Requirements for wear-resistant sintered hard materials have become increasingly severe, and the industry has sought improved materials having wear-resistance as well as heat-resistance and corrosion resistance or the like.

As sintered hard materials, carbides, nitrides and carbonitrides such as WC base hard alloys and TiCN type cermets are well known. As substitute materials for the aforementioned hard materials, hard alloys and cermets including metallic borides such as WB and $TiB_2$, and metallic complex borides such as $Mo_2FeB_2$ and $Mo_2NiB_2$ have been recently proposed, noting excellent properties of borides such as extreme hardness, high melting point and high electric conductivity. Further, stellites are utilized as cobalt base wear-resistant materials.

A hard alloy formed by binding WB with a nickel base alloy such as disclosed in Japanese Patent Publications No. Sho 56-45985, No. Sho 56-45986 and No. Sho 56-45987 is a paramagnetic wear-resistant material to be used especially in watch cases and ornaments, and is not intended for structural materials to be used at high temperature.

Ceramics comprising metallic borides such as $TiB_2$ as disclosed in Japanese Patent Publications No. Sho 61-50909 and No. Sho 63-5353 exhibit extreme hardness and pronounced heat resistance, but impart poor thermal shock resistance due to there being no metallic binding matrix phase.

Generally, hard materials formed by adding metals to metallic borides suffer from the disadvantage in that they tend to form a brittle third phase, and it is difficult to obtain high strength or toughness.

Hard alloys comprising metallic complex borides such as $Mo_2FeB_2$ and $Mo_2NiB_2$ formed by reaction during sintering have been developed to eliminate the above disadvantage.

A $Mo_2FeB_2$ type hard alloy disclosed in Japanese Patent Publication No. Sho 60-57499 has excellent mechanical properties, wear-resistance and corrosion resistance at room temperature but unsatisfactory high temperature strength and oxidation resistance due to its iron base binding matrix phase.

A $Mo_2NiB_2$ type hard alloy disclosed in Laid Open Japanese Patent application No. Sho 62-196353 has excellent high temperature properties and corrosion resistance, but poor wear-resistance and anti-adhesion property, since the complex boride $Mo_2NiB_2$ is about 15 Gpa at micro-Vickers hardness and is not so hard, and its binding phase consists of nickel base alloy. Stellites exhibit excellent high temperature properties, but their hardness is too low to be used for wear-resistant materials.

It is an object of the present invention to provide a sintered hard alloy having excellent room temperature properties as well as pronounced high temperature properties such as high temperature strength and oxidation resistance.

SUMMARY OF THE INVENTION

According to the present invention, there is provided a heat-resistant sintered hard alloy comprising 35 to 95% by weight of a WCoB type complex boride and a cobalt base alloy matrix phase. The hard alloy may consist of boron of 1.5 to 4.1% by weight, tungsten of 19.1 to 69.7% by weight with the balance being cobalt and unavoidable impurities. In addition to the above elements, the hard alloy may contain chromium of 1 to 25% by weight for the improvement of mechanical properties and corrosion resistance. Further, the hard alloy may comprise boron of 1.5 to 4.1% by weight, tungsten of 19.to 69.7% by weight, chromium of 1 to 25% by weight, and at lest one of nickel, iron and copper. Nickel, when present, substitutes for cobalt in the range of 0.2 to 30% by weight of cobalt content. Iron, when present, substitutes for cobalt in the range of 0.2 to 15% by weight of cobalt content. Copper, when present, substitutes for cobalt in the range of 0.1 to 7.5% by weight of cobalt content. The balance of this alloy consists of cobalt and unavoidable impurities.

DETAILED DESCRIPTION OF THE INVENTION

In this description, WCoB and a complex boride identified as WCoB by means of x-ray diffraction comprising tungsten and cobalt, in which part tungsuten may be replaced by chromium and part of the cobalt may be replaced by chromium, nickel, iron or copper, will be referred to as a WCoB type complex boride.

The WCoB type complex boride offers the following advantages. The formation of a brittle third phase, which tends to be formed in a boride base hard alloy, can be suppressed by forming the WCoB type complex boride by reaction during sintering. The micro-Vickers hardness of the WCoB type boride is larger than 30 GPa, and higher than those of other metallic complex borides such as $Mo_2FeB_2$ and $Mo_2NiB_2$,and the same as or higher than those of carbides and nitrides which are currently used for hard materials. Further, the WCoB type complex boride has excellent oxidation resistance.

In the case where the content of the WCoB type complex boride is less than 35% by weight, the wear resistance of the hard alloy is reduced due to the insufficient amount of the complex boride, and is liable to marked deformation at high temperature due to insufficient development of complex boride networks in the cobalt base alloy matrix phase. On the other hand, in the case where the content of the WCoB type complex boride is more than 95% by weight, the strength of the hard alloy is remarkably decreased, though its hardness is increased. For the above reason, it is preferable that the content of the WCoB type complex boride be 35 to 95% by weight.

Boron is an essential element for forming the WCoB type complex boride in the heat-resistant sintered hard alloy. With boron less than 1.5% by weight, the complex boride is less than 35% by weight, and with boron more than 4.1% by weight, the complex boride is over 95% by weight, leading to a pronounced decrease in the strength of the hard alloy. For the above reason, it is preferable that the amount of boron in the hard alloy be from 1.5 to 4.1% by weight.

Tungsten is also an essential element for forming the WCoB type complex boride. The stoichiometric ratio in the WCoB type complex boride is such that W:Co:B=1:1:1. The WCoB type complex boride which is practically applicable, however, need not be a perfectly stoichiometric compound, but may have a composition variance of a few percent. Accordingly, the molecular ratio of W/B (hereafter will be referred to as W/B ratio) need not be 1, but it is important that the W/B ratio be within a specific range including 1 as the approximate centre.

Test results indicate that in the case where the W/B ratio is far smaller than 1, cobalt borides such as $Co_2B$ is formed, and in the case where the W/B ratio is far larger than 1, intermetallic compounds of tungsten and cobalt such as $W_6Co_7$ are formed, leading to a decrease in the strength of the hard alloy in both cases.

When the W/B ratio is within the range of 0.75 to $0.135\times(11.5-X)$, where X indicates the content of boron by weight percent, even if the above third phase is formed, the third phase will little affect the strength of the hard alloy; i.e., there would be an allowable decrease in the strength.

In the case where the W/B ratio is larger than 1, part of excess tungsten will be solid solute into the cobalt base alloy matrix phase, which will strengthen the matrix phase, thus improving the mechanical properties of the heat-resistant sintered hard alloy. However, since the amount of the cobalt base alloy matrix phase decreases with the increase of the amount of the WCoB type complex boride, it is necessary to decrease the amount of said excess tungsten in the matrix phase accompanied by the above increase, so as to maintain the strength of the hard alloy.

For the above reason, it is preferable that the upper limit of the amount of tungsten be 1.35 in terms of the W/B ratio in the case where the amount of boron is lowest (1.5% by weight), and 1 in terms of the W/B ratio in the case where the amount of boron is highest (4.1% by weight). This range is represented by the formula $0.135\times(11.5-X)$, in which X is the weight percent of boron.

Accordingly, it is desirable that the amount of tungsten in the hard alloy be in the range of from 0.75 to $0.135\times(11.5-X)$, preferably in the range of 0.8 to $0.135\times(11.5-X)$ in terms of the W/B ratio; that is, from 19.1 to 69.7% by weight, preferably from 20.4 to 69.7% by weight, in said hard alloy.

In the case of a sintered hard alloy containing chromium, it is presumed that chromium will be solid solute into the WCoB type complex boride, and form a $(W_xCo_yCr_z)B$ multiple boride of the WCoB type complex boride, in which cobalt rather than tungsten is replaced partially by chromium and $x+y+z$ is equal to 2, and further chromium will be solid solute into the cobalt base alloy matrix also, so that the resistances to corrosion, heat and oxidation of the sintered hard alloy will be improved.

Furthermore, chromium refines the $(W_xCo_yCr_z)B$ multiple boride phase and improves the mechanical properties of the sintered hard alloy. With a content of chromium below 1% by weight, the above-mentioned improvement can not be attained, and with the content of chromium above 25% by weight, the mechanical properties of the sintered hard alloy are remarkably decreased due to the generation of a brittle phase such as a CoCr sigma ($\sigma$) phase. Accordingly, it is preferable that the content of chromium be from 1 to 25% by weight.

In the case of a sintered hard alloy containing nickel, it is presumed that nickel will substitute for cobalt and be solid solute into the cobalt base alloy matrix phase, and improve the mechanical properties, corrosion resistance and heat-resistance of the hard alloy. With the substitution of nickel below 0.2% by weight of cobalt content, the aforementioned improvements of mechanical properties and the like can not be attained, and with the substitution of nickel above 30% by weight of cobalt, abrasion resistance is reduced due to the decrease of hardness. Accordingly, it is preferable that nickel substitute for cobalt in the range of 0.2 to 30 % by weight of cobalt content.

Iron substitutes mainly for cobalt in the WCoB type complex boride and the cobalt base alloy matrix phase, and improves the strength at low temperature. With the substitution of iron below 0.2% by weight of cobalt content, the aforementioned improvement is not attained, and with the substitution of iron more than 15% by weight of cobalt content, the hard alloy becomes less resistant to corrosion, heat and oxidation. Accordingly, in the case of the sintered hard alloy containing iron, it is preferable that iron substitute for cobalt in the range of 0.2 to 15% by weight of cobalt content.

Copper substitutes for cobalt and is solid solute into the cobalt base alloy matrix phase, and improves the corrosion resistance and heat conductivity of the sintered hard alloy. With the substitution of copper below 0.1% by weight of cobalt content, the above improvements are not attained, and with the substitution of copper more than 7.5% by weight of cobalt content, the mechanical properties and heat-resistance are degraded. Accordingly, it is preferable that copper substitute for cobalt in the range of 0.1to 7.5% by weight of cobalt content, when copper is added to the sintered hard alloy.

The unavoidable impurities contained in the sintered hard alloy are mainly silicon, aluminum, manganese, magnesium, phosphorus, sulfur, nitrogen, oxygen, carbon or the like, and it is desirable that the content of these impurity elements be as little as possible. However, in the case where the total amount of these impurity elements is less than 1.0% by weight, the detrimental effects thereof to the properties of the sintered hard alloy are relatively small. Accordingly, it is preferable that the total content of the unavoidable impurities be less than 1.0% by weight, more preferably less than 0.5% by weight.

In the case where the sintered hard alloy is employed for a wear-resistant coating in which the strength is not of critical importance, and silicon and aluminum or the like are added intentionally so as to improve the oxidation resistance of the coating, the total content of the aforementioned elements may be over 1.0% by weight.

The sintered hard alloy is made by mixing boride powders of tungsten, cobalt, chromium, nickel and iron; alloy powders of boron, with at least one of tungsten, cobalt, chromium, nickel, iron and copper; or boron powder and metal powders of tungsten, cobalt, chromium, nickel, iron and copper, or alloy powders containing at least two of these metallic elements, thereafter wet milling the mixture with an organic solvent by means of a vibrating ball mill or the like, drying, granulating, and forming, followed by liquid phase sintering of the green compact in a non-oxidizing atmosphere such as in vacuum, a reducing gas, or an inert gas.

The hard phase, that is the WCoB type complex boride of the sintered hard alloy, is formed by the reaction during sintering. A powder mixture obtained by blending metal powders such as cobalt, chromium and nickel to form the Co base alloy matrix phase, with the WCoB type complex boride such as WCoB and $(W_xCo_yCr_z)B$ which are prepared by reacting tungsten boride, cobalt boride, boron powder with metal powders such as tungsten, cobalt and chromium etc. in a furnace in advance, may be employed as the raw material powders also.

The liquid phase sintering is usually carried out at the temperature range of 1100° to 1400° C. and for 5 to 90 minutes depending on the composition of the hard alloy. A hot press method, a hot isostatic pressing method, and an electric resistance sintering method or the like may be also employed.

EXAMPLES

The compound powders listed in Table 1 and metal powders listed in Table 2 were blended in the compositions shown in Table 3 with the blending ratios shown in Table 5. The blended powders were wet milled with acetone by means of a vibrating ball mill for 28 hours and then dried and granulated. The powders thus obtained were pressed into a predetermined shape. The green compacts were sintered at the temperature of 1150° to 1300° for 30 minutes in vacuum.

The transverse rupture strength and Rockwell A scale hardness ($R_A$) at room temperature, the transverse rupture strength at 900° C., and the weight gain by oxidation after holding at the temperature of 900° C. for 1 hour in still air of the samples of the hard alloys thus obtained are shown in Table 7.

Sample Nos. 1 to 10 all show extreme hardness and high transverse rupture strength at room temperature as well as high transverse rupture strength and excellent oxidation resistance at the high temperature. A hot extruding die was prepared using the hard alloy of sample No. 6, and a pure copper rod was extruded through the die. It was possible to extrude the rod 50 to 100 times satisfactorily. A similar die formed with a WC-Co type hard alloy could not be used practically for the pure copper rod hot extrusion.

COMPARATIVE EXAMPLES

The compound powders listed in Table 1 and the metal powders listed Table 2 were blended in the composition shown in Table 4 with the blending ratios shown in Table 6.

The hard alloys were prepared by the same method as shown in the EXAMPLES, and the properties thereof are shown in Table 8.

Sample No. 11 has a W/B ratio less than 0.75, and exhibits low transverse rupture strength at room temperature as well as the high temperature. Sample No. 12 exhibits low transverse rupture strength at the high temperature and poor oxidation resistance due to the content of iron being higher than 10% by weight, though it shows high transverse rupture strength at room temperature. Sample No. 13, containing a MoCoB type complex boride instead of the WCoB type complex boride, exhibits low transverse rupture strength at room temperature as well as the high temperature, compared with the samples of EXAMPLES having approximately the same hardness. Sample No. 14 containing a $Mo_2FeB_2$ type complex boride exhibits low transverse rupture strength at high temperature and poor oxidation resistance.

A similar hot extruding die as described in the EXAMPLES was prepared using the hard alloy of Sample No. 14, and a copper rod was extruded in the same manner as in the case of the EXAMPLES. Only 5 to 10 times extruding was possible with the die.

TABLE 1

| Compound powder | B wt % | C wt % | N wt % | O wt % | W wt % | Fe wt % | Cr wt % | Mo wt % |
|---|---|---|---|---|---|---|---|---|
| WB | 5.5 | 0.03 | 0.1 | 0.07 | 94.3 | — | — | — |
| CrB | 17.4 | 0.20 | 0.04 | 0.16 | — | — | 82.2 | — |
| MoB | 10.0 | 0.05 | 0.02 | 0.2 | — | 0.03 | — | 89.7 |

TABLE 2

| Metal powder | Purity wt % | Metal powder | Purity wt % |
|---|---|---|---|
| W | 99.95 | Fe | 99.69 |
| Cr | 99.75 | Cu | 99.9 |
| Ni | 99.75 | Co | 99.87 |

TABLE 3

| Sample No. | Composition (wt %) B | W | Cr | Ni | Fe | Cu | Co | W/B ratio | Amount of complex boride (wt %) |
|---|---|---|---|---|---|---|---|---|---|
| 1 | 3.0 | 51.4 | — | — | — | — | bal. | 1.0 | 71 |
| 2 | 1.9 | 35.5 | 15.0 | — | — | — | bal. | 1.1 | 44 |
| 3 | 1.9 | 42.0 | 10.0 | — | — | — | bal. | 1.3 | 44 |
| 4 | 2.2 | 29.9 | 15.0 | — | — | — | bal. | 0.8 | 41 |
| 5 | 3.0 | 53.4 | 5.0 | — | — | — | bal. | 1.05 | 70 |
| 6 | 2.0 | 34.3 | 21.0 | 5.0 | — | — | bal. | 1.0 | 46 |
| 7 | 3.8 | 58.2 | 5.0 | 1.0 | — | — | bal. | 0.9 | 80 |
| 8 | 1.7 | 29.1 | 21.0 | 5.0 | 5.0 | — | bal. | 1.0 | 39 |
| 9 | 2.5 | 46.8 | 10.0 | 10.0 | 0.2 | — | bal. | 1.1 | 58 |
| 10 | 1.9 | 33.5 | 10.0 | 3.0 | — | 2.0 | bal. | 1.0 | 44 |

TABLE 4

| Sample No. | Composition (wt %) B | W | Cr | Ni | Fe | Mo | Co | W/B ratio | Amount of complex boride (wt %) |
|---|---|---|---|---|---|---|---|---|---|
| 11 | 2.4 | 28.6 | 7.0 | — | — | — | bal. | 0.7 | 39 |
| 12 | 3.0 | 51.4 | 5.0 | — | 15.0 | — | bal. | 1.0 | 70 |
| 13 | 3.0 | — | 21.0 | 5.0 | — | 26.9 | bal. | — | MoCoB 45 |
| 14 | 4.0 | — | 17.1 | 10.0 | bal. | 33.7 | — | — | $Mo_2FeB_2$ 57 |

TABLE 5

| Sample No. | WB wt % | W wt % | Cr wt % | Ni wt % | Fe wt % | Cu wt % | CrB wt % | Co wt % |
|---|---|---|---|---|---|---|---|---|
| 1 | 54.5 | — | — | — | — | — | — | 45.5 |
| 2 | 34.5 | 3.0 | 15.0 | — | — | — | — | 47.5 |

TABLE 5-continued

| Sample No. | WB wt % | W wt % | Cr wt % | Ni wt % | Fe wt % | Cu wt % | CrB wt % | Co wt % |
|---|---|---|---|---|---|---|---|---|
| 3 | 34.5 | 9.5 | 10.0 | — | — | — | — | 46.0 |
| 4 | 31.7 | — | 12.9 | — | — | — | 2.6 | 52.8 |
| 5 | 54.5 | 2.0 | 5.0 | — | — | — | — | 38.5 |
| 6 | 36.4 | — | 21.0 | 5.0 | — | — | — | 37.6 |
| 7 | 61.7 | — | 3.0 | 1.0 | — | — | 2.4 | 31.9 |
| 8 | 30.9 | — | 21.0 | 5.0 | 5.0 | — | — | 38.1 |
| 9 | 45.5 | 3.9 | 10.0 | 10.0 | 0.2 | — | — | 30.4 |
| 10 | 34.5 | — | 10.0 | 3.0 | — | 2.0 | — | 50.5 |

TABLE 6

| Sample No. | WB wt % | W wt % | Cr wt % | Ni wt % | Fe wt % | MoB wt % | CrB wt % | Co wt % |
|---|---|---|---|---|---|---|---|---|
| 11 | 30.3 | — | 3.5 | — | — | — | 4.2 | 62.0 |
| 12 | 54.5 | — | 5.0 | — | 15.0 | — | — | 25.5 |
| 13 | — | — | 21.0 | 5.0 | — | 30.0 | — | 44.0 |
| 14 | — | — | 16.0 | 10.0 | 35.1 | 37.6 | 1.3 | — |

TABLE 7

| Sample No. | Transverse rupture strength (RT, GPa) | Hardness ($R_A$) | Transverse rupture strength (900° C., GPa) | Oxidation weight gain ($mg/mm^2/h$) |
|---|---|---|---|---|
| 1 | 1.95 | 82.7 | 1.79 | 9.76 |
| 2 | 3.08 | 79.2 | 1.90 | 0.84 |
| 3 | 2.67 | 79.2 | 1.94 | 1.27 |
| 4 | 2.24 | 78.3 | 1.95 | 0.42 |
| 5 | 2.29 | 84.5 | 1.97 | 4.24 |
| 6 | 2.01 | 77.9 | 1.80 | 0.84 |
| 7 | 1.85 | 89.5 | 1.71 | 3.18 |
| 8 | 2.56 | 76.2 | 1.83 | 0.84 |
| 9 | 2.46 | 80.8 | 2.03 | 1.15 |
| 10 | 2.70 | 78.0 | 1.81 | 1.39 |

TABLE 8

| Sample No. | Transverse rupture strength (RT, GPa) | Hardness ($R_A$) | Transverse rupture strength (900° C., GPa) | Oxidation weight gain ($mg/mm^2/h$) |
|---|---|---|---|---|
| 11 | 1.63 | 81.6 | 1.42 | 6.37 |
| 12 | 2.31 | 85.5 | 1.63 | 13.9 |

TABLE 8-continued

| Sample No. | Transverse rupture strength (RT, GPa) | Hardness ($R_A$) | Transverse rupture strength (900° C., GPa) | Oxidation weight gain ($mg/mm^2/h$) |
|---|---|---|---|---|
| 13 | 1.81 | 78.7 | 1.28 | 1.63 |
| 14 | 1.93 | 79.1 | 1.39 | 20.4 |

We claim:

1. A heat-resistant sintered hard alloy containing 35 to 95% by weight of a WCoB type complex boride containing chromium in a cobalt base alloy matrix phase, wherein said hard alloy consists of 1.5 to 4.1% by weight of boron, 19.1 to 69.7% by weight of tungsten, 1 to 25% by weight of chromium, the balance being cobalt, and a maximum of 1%, by weight of the alloy, of unavoidable impurities.

2. A heat-resistant sintered hard alloy according to claim 1, which further comprises at least one of nickel, iron and copper, wherein nickel, when present, substitutes for cobalt in the range of 0.2 to 30% by weight of cobalt content, iron, when present, substitutes for cobalt in the range of 0.2 to 15% by weight of cobalt content, and copper, when present, substitutes for cobalt in the range of 0.1 to 7.5% by weight of cobalt content.

* * * * *